US009301596B1

(12) United States Patent
Parker

(10) Patent No.: US 9,301,596 B1
(45) Date of Patent: Apr. 5, 2016

(54) ATTACHMENT ASSEMBLY FOR AN ELECTRONIC DEVICE

(71) Applicant: Steven Parker, Newark, NJ (US)

(72) Inventor: Steven Parker, Newark, NJ (US)

( * ) Notice: Subject to any disclaimer, the term of this patent is extended or adjusted under 35 U.S.C. 154(b) by 130 days.

(21) Appl. No.: 14/211,074

(22) Filed: Mar. 14, 2014

(51) Int. Cl.
*B65H 75/38* (2006.01)
*A45F 5/00* (2006.01)
*A45F 5/02* (2006.01)

(52) U.S. Cl.
CPC .. *A45F 5/004* (2013.01); *A45F 5/02* (2013.01)

(58) Field of Classification Search
CPC ..... B65H 75/48
USPC ..... 242/378.1–378.4, 405; 191/12.4
See application file for complete search history.

(56) References Cited

U.S. PATENT DOCUMENTS

| | | | | |
|---|---|---|---|---|
| 6,073,875 | A | 6/2000 | Paugh | |
| 6,257,469 | B1 | 7/2001 | Cohn | |
| 6,290,158 | B1 | 9/2001 | Huang | |
| 6,364,237 | B1 * | 4/2002 | Kagel | 242/379 |
| 6,427,374 | B1 | 8/2002 | Vaiani | |
| 6,502,727 | B1 | 1/2003 | Decoteau | |
| 7,354,304 | B2 * | 4/2008 | Livingston | 439/501 |
| 7,665,684 | B2 | 2/2010 | Salentine et al. | |
| D675,012 | S | 1/2013 | Votel et al. | |

* cited by examiner

*Primary Examiner* — Sang Kim

(57) ABSTRACT

An attachment assembly for an electronic device attaches to an electronic device, such as a cell phone, to prevent a user from dropping, losing or breaking the electronic device. The assembly includes a housing having a top wall, a bottom wall and a perimter wall coupled to and extending between the top wall and the bottom wall. A tether is retractable into and out of the housing. The tether has a first end extending outwardly of the housing. A connector is coupled to the first end of the tether. The connector is configured for releasably attaching an electronic device to the tether.

12 Claims, 3 Drawing Sheets

ATTACHMENT ASSEMBLY FOR AN ELECTRONIC DEVICE

BACKGROUND OF THE DISCLOSURE

Field of the Disclosure

The disclosure relates to electronic device attachment apparatuses and more particularly pertains to a new electronic device attachment apparatus for attaching to an electronic device, such as a cell phone, to prevent a user from dropping, losing or breaking the electronic device.

SUMMARY OF THE DISCLOSURE

An embodiment of the disclosure meets the needs presented above by generally comprising a housing having a top wall, a bottom wall and a perimter wall coupled to and extending between the top wall and the bottom wall. A tether is retractable into and out of the housing. The tether has a first end extending outwardly of the housing. A connector is coupled to the first end of the tether. The connector is configured for releasably attaching an electronic device to the tether.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
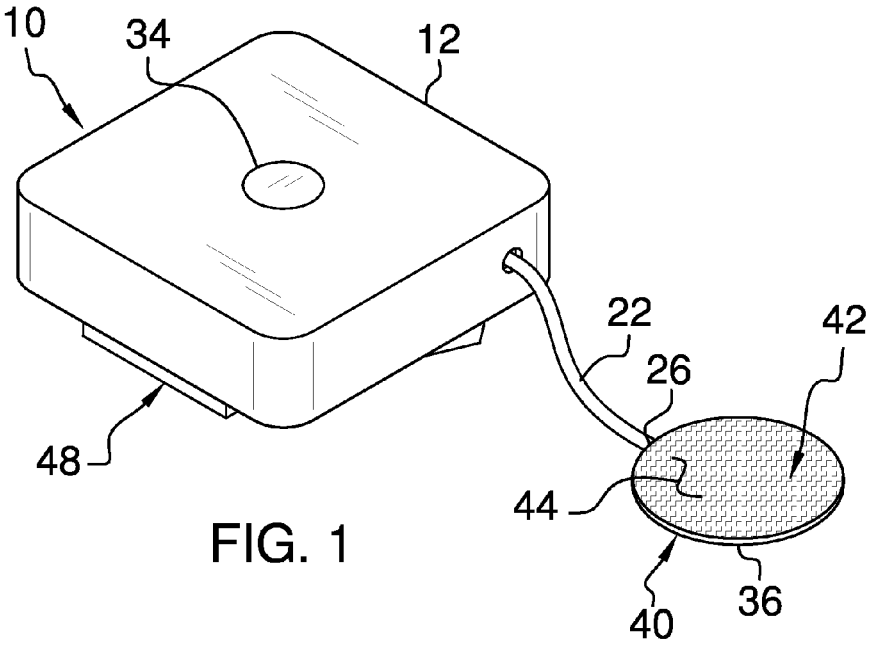
FIG. 1 is a top front side perspective view of an attachment assembly for an electronic device according to an embodiment of the disclosure.
Figure 2:
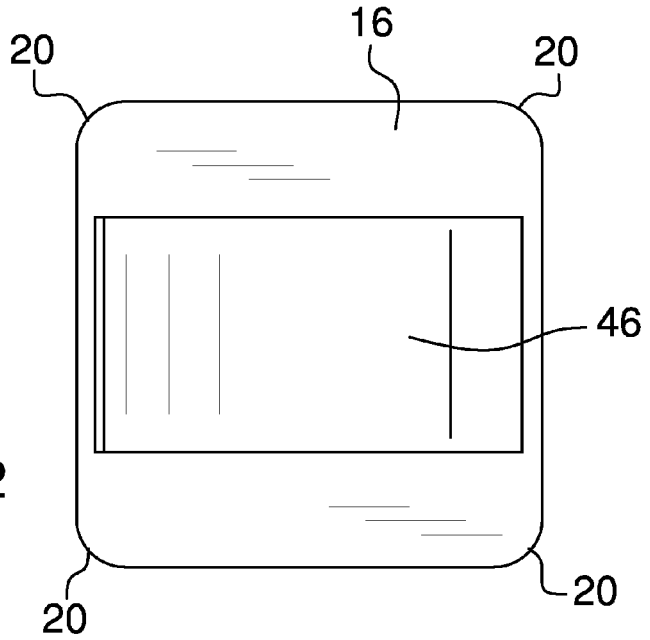
FIG. 2 is a bottom view of an embodiment of the disclosure.
Figure 3:
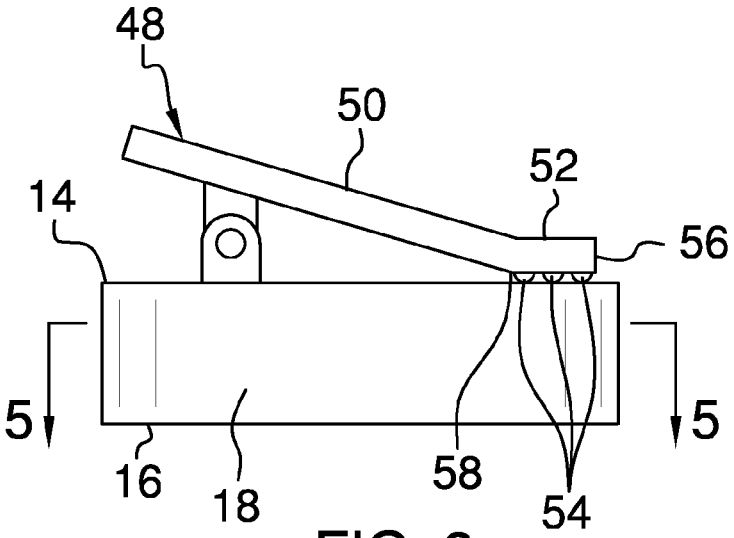
FIG. 3 is a side view of an embodiment of the disclosure.
Figure 4:
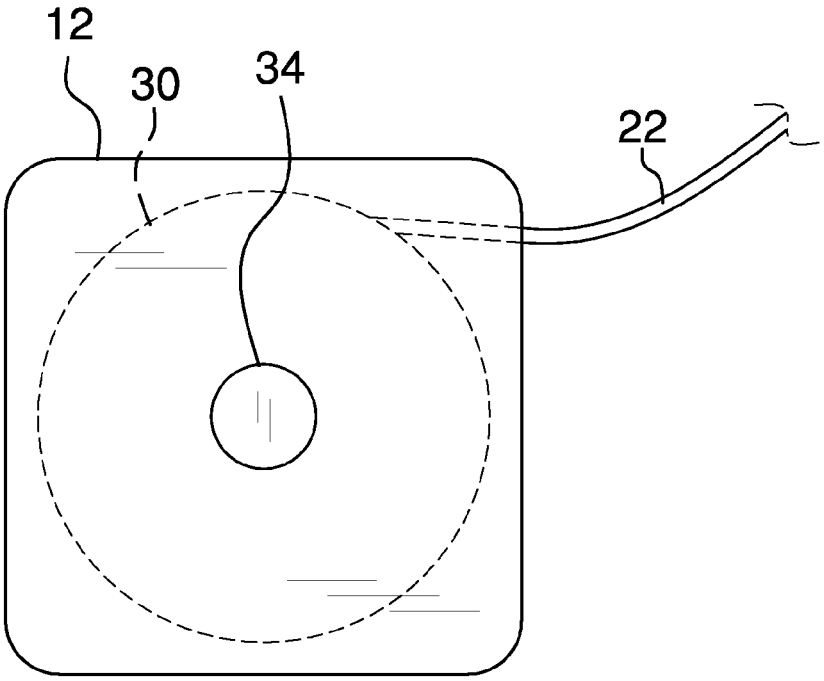
FIG. 4 is a top view of an embodiment of the disclosure.
Figure 5:
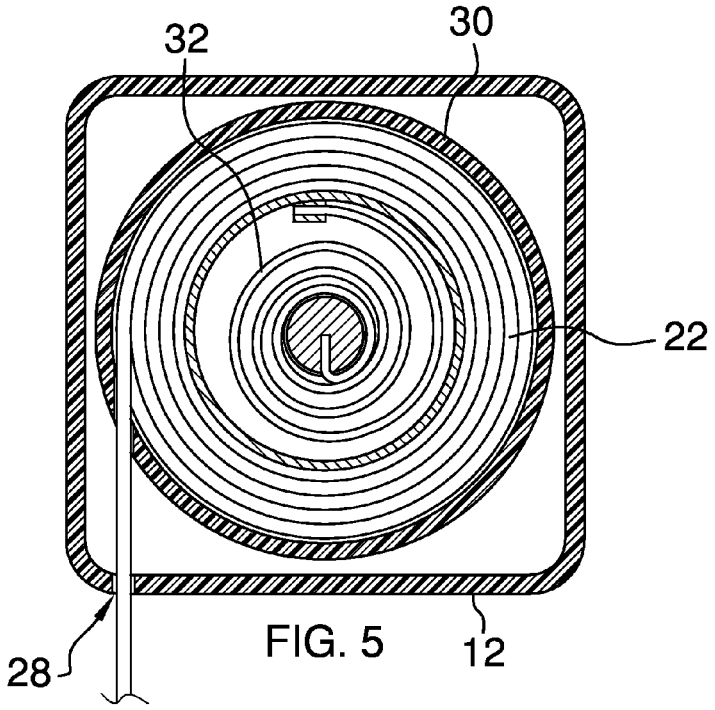
FIG. 5 is a cross-sectional view of an embodiment of the disclosure taken along line 5-5 of FIG. 3.
Figure 6:
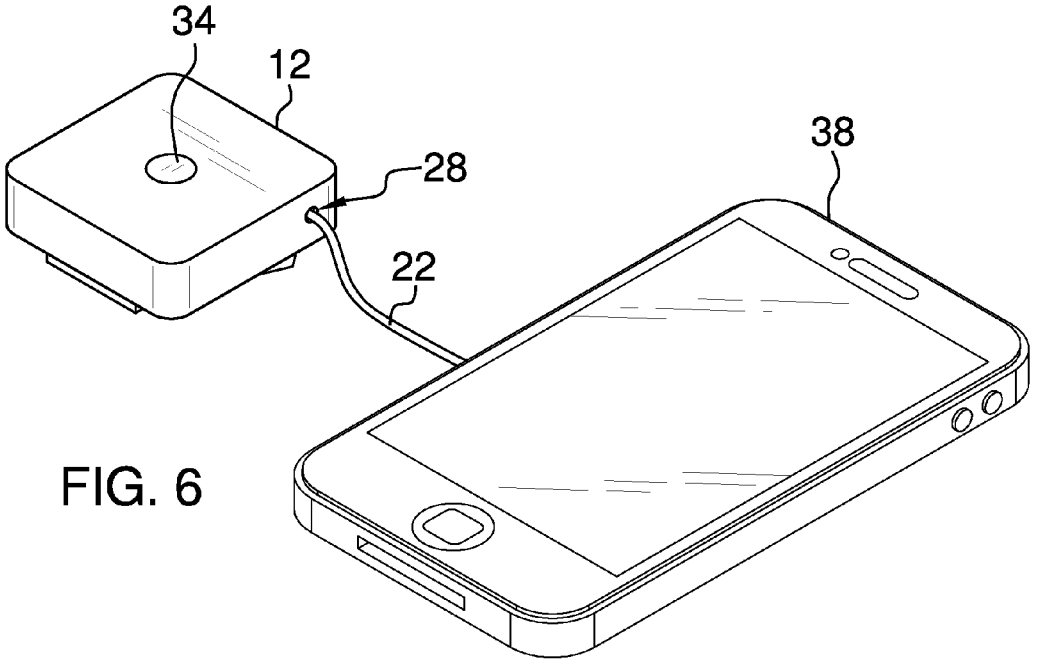
FIG. 6 is a top front side perspective view of an embodiment of the disclosure in use.

With reference now to the drawings, and in particular to FIGS. 1 through 6 thereof, a new electronic device attachment apparatus embodying the principles and concepts of an embodiment of the disclosure and generally designated by the reference numeral 10 will be described.

As best illustrated in FIGS. 1 through 6, the attachment assembly for an electronic device 10 generally comprises a housing 12 having a top wall 14, a bottom wall 16 and a perimeter wall 18 coupled to and extending between the top wall 14 and the bottom wall 16. The housing 12 may have a plurality of rounded edges 20. A tether 22 is retractable into and out of the housing 12. The tether 22 has a first end 26 extending outwardly of the housing 12. An opening 28 is positioned in the housing 12. The tether 22 is retractable into and out of the housing 12 through the opening 28.

A spool 30 is positioned in the housing 12. The tether 22 is rotatably mounted around the spool 30 to store the tether 22 in a coiled manner on the spool 30. A biaising member 32 is mounted within the housing 12. The biasing member 32 is mechanically coupled to the tether 22 wherein the biasing member 32 facilitates retraction of the tether 22 into the housing 12. A post 34 is mounted in a center of the spool 30. The biasing member 32 is rotatably mounted around the post 34.

A connector 36 is coupled to the first end 26 of the tether 22. The connector 36 is configured for releasably attaching an electronic device 38 to the tether 22. The connector 36 includes a planar panel 40. The panel 40 may be annular. A top surface 42 of the panel 40 has a coupler 44 attached thereto. The coupler 44 may comprise a first portion of a hook and loop coupler or other similar fastener that is configured to attach to a complementary mating member attached to the electronic device 38. The coupler 44 may cover an entirety of the top surface 42 of the panel 40.

A fastener 46 is attached to the bottom wall 16 of the housing 12. The fastener 46 is configured to attach the housing 12 to a securing structure, such as a belt, purse or the like. In particular, the fastener 46 comprises a clip 48. The clip 48 may be pivotally coupled to the bottom wall 16 of the housing 12. The clip 48 includes a first planar portion 50 and a second planar portion 52. The first planar portion 50 is angled outwardly and upwardly relative to the second planar portion 52.

A plurality of protruberances 54 is coupled to the clip 48 proximate a bottom end 56 of the clip 48. The protruberances 54 are configured to abut the bottom wall 16 of the housing 12 such that the protruberances 54 facilitate securing of the clip 48 around the securing structure. The protruberances 54 are attached to a bottom surface 58 of the second planar portion 52 of the clip 48.

In use, as stated above and shown in the Figures, the coupler 44 is attached to an electronic device 38, such as a cell phone. The clip 48 is then attached to a belt or the like to secure the electronic device 38 to the belt. The biasing member 32 automatically retracts the tether 22 into the housing 12 to help prevent the electronic device 38 from being lost or stolen.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An attachment assembly for an electronic device comprising:

a housing having a top wall, a bottom wall and a perimeter wall coupled to and extending between said top wall and said bottom wall;

a tether being retractable into and out of said housing, said tether having a first end extending outwardly of said housing; and a connector coupled to said first end of said tether, said connector being configured for releasably attaching an electronic device to said tether;

a fastener attached to said bottom wall of said housing, said fastener being configured to attach said housing to a securing structure, said fastener comprising a clip, said clip being pivotally coupled to said bottom wall of said housing, said clip including a first planar portion and a second planar portion, said first planar portion being angled outwardly and upwardly relative to said second planar portion; and a plurality of protruberances coupled to said clip proximate a bottom end of said clip, said protruberances being configured to abut said bottom wall of said housing such that said protruberances facilitate securing of said clip around the securing structure, said protruberances being attached to a bottom surface of said second planar portion wherein said protuberances face said housing.

2. The assembly of claim 1, further comprising said housing having a plurality of rounded edges.

3. The assembly of claim 1, further comprising a spool positioned in said housing, said tether being rotatably mounted around said spool to store said tether in a coiled manner on said spool.

4. The assembly of claim 3, further comprising a biasing member mounted within said housing, said biasing member being mechanically coupled to said tether wherein said biasing member facilitates retraction of said tether into said housing.

5. The assembly of claim 4, further comprising a post mounted in a center of said spool, said biasing member being rotatably mounted around said post.

6. The assembly of claim 1, further comprising an opening positioned in said housing, said tether being retractable into and out of said housing through said opening.

7. The assembly of claim 1, further comprising said connector including a planar panel.

8. The assembly of claim 7, wherein said panel is annular disc-shaped.

9. The assembly of claim 7, further comprising a top surface of said panel having a coupler attached thereto.

10. The assembly of claim 9, further comprising said coupler comprising a first portion of a hook and loop coupler.

11. The assembly of claim 10, further comprising said coupler covering an entirety of said top surface of said panel.

12. An attachment assembly for an electronic device comprising:

a housing having a top wall, a bottom wall and a perimeter wall coupled to and extending between said top wall and said bottom wall, said housing having a plurality of rounded edges;

a tether being retractable into and out of said housing, said tether having a first end extending outwardly of said housing;

a spool positioned in said housing, said tether being rotatably mounted around said spool to store said tether in a coiled manner on said spool;

an opening positioned in said housing, said tether being retractable into and out of said housing through said opening;

a biasing member mounted within said housing, said biasing member being mechanically coupled to said tether wherein said biasing member facilitates retraction of said tether into said housing;

a post mounted in a center of said spool, said biasing member being rotatably mounted around said post;

a connector coupled to said first end of said tether, said connector being configured for releasably attaching an electronic device to said tether, said connector including a planar panel, said panel being annular, a top surface of said panel having a coupler attached thereto, said coupler comprising a first portion of a hook and loop coupler, said coupler covering an entirety of said top surface of said panel;

a fastener attached to said bottom wall of said housing, said fastener being configured to attach said housing to a securing structure, said fastener comprising a clip, said clip being pivotally coupled to said bottom wall of said housing, said clip including a first planar portion and a second planar portion, said first planar portion being angled outwardly and upwardly relative to said second planar portion; and a plurality of protruberances coupled to said clip proximate a bottom end of said clip, said protruberances being configured to abut said bottom wall of said housing such that said protruberances facilitate securing of said clip around the securing structure, said protruberances being attached to a bottom surface of said second planar portion of said clip wherein said protuberances face said housing.

* * * * *